US005651612A

United States Patent [19]

Braun

[11] Patent Number: 5,651,612

[45] Date of Patent: Jul. 29, 1997

[54] TORSION FLEX SHIELD (FLAT) - PROTECTIVE LENS SHIELD WITH TORSION MOUNTING BRACKET FOR OUTDOOR LIGHTING FIXTURES

[76] Inventor: Steven G. Braun, 1418 Ponderosa, Fullerton, Calif. 92635

[21] Appl. No.: 356,976

[22] Filed: Feb. 7, 1995

[51] Int. Cl.[6] ..... F21V 15/00

[52] U.S. Cl. ..... 362/376; 362/431

[58] Field of Search ..... 362/374, 376, 362/377, 378, 431, 311, 282, 322

[56] References Cited

U.S. PATENT DOCUMENTS

| | | | |
|---|---|---|---|
| 3,315,072 | 4/1967 | Harling | 240/2.5 |
| 4,010,362 | 3/1977 | Fletcher | 240/147 |
| 4,160,286 | 7/1979 | Merritt | 362/376 X |
| 4,432,045 | 2/1984 | Merritt | 362/376 |
| 4,460,945 | 7/1984 | Chan et al. | 362/294 |

*Primary Examiner*—Stephen F. Husar
*Attorney, Agent, or Firm*—Price, Gess & Ubell

[57] ABSTRACT

A flat tear drop shaped protective lens shield (12) with a torsion adjustment system (3) and simple one bolt mounting bracket clamp (1). The protective lens shield is constructed of dual layers and thicknesses of polycarbonate sheets (12) which have ballistic containment properties. The bracket clamp (1), clamp bolt assembly (2), adjustment carriage bolt (3), threaded adjustment housing (4), and arm-shield adjustment arm (5) are constructed of steel with a galvanized coating for a corrosion resistant longer life. The hook and cable assembly (FIG. 2) is comprised of a hook (8), cable (9), and a cable assembly bolt (10) which is stainless steel corrosion resistant materials. The torsion flex system is enhanced by the adjustable torsion carriage bolt (3). This adjustment allows for a flex in the polycarbonate sheets allowing it to absorb the energy from objects attempting to penetrate the shield (12). The rubber grommets (11) allow for movement, yet they hold the polycarbonate sheets together to perform the task of an expansion joint The hook and cable assembly (FIG. 2) allows for a custom attachment to the existing light lens cover (6A) no matter where the location of the interior gussets are positioned. This custom attachment allows this protection shield to adapt to any make or model cobra head street light. This protective shield is lightweight, easily attached to the pole arm (13) and swings away for easy luminaire maintenance.

20 Claims, 2 Drawing Sheets

TORSION FLEX SHIELD (FLAT) - PROTECTIVE LENS SHIELD WITH TORSION MOUNTING BRACKET FOR OUTDOOR LIGHTING FIXTURES

BACKGROUND—FIELD OF THE INVENTION

This invention relates to outdoor lighting fixtures, such as street lights, or luminaries, and more particularly to a protective lens shield designed with a special torsion mounting bracket for such light-diffusing lenses of outdoor street lighting and/or luminaries.

BACKGROUND—DESCRIPTION OF PRIOR ART

Outdoor street lighting fixtures customarily have a light lens which covers the light-producing means emitting light from the luminaire. This lens is conventionally constructed of glass which makes it vulnerable to frequent breakage by vandalism. Because of lens breakage, increased maintenance costs are incurred in order to properly maintain the quality of outdoor street lighting. The lens diffuses and protects the light from the light-producing means of the luminaire. Lens breakage may subject persons to increased crime, injury, drug trafficking, and unsafe auto/pedestrian travel due to non-functioning street lights. Lens breakage may also create injury due to broken glass.

Historically, light-diffusing lenses have been made of synthetic products such as polycarbonate resin which has a greater impact resistance, and is subject to less breakage than glass. These replacement lenses are subject to less breakage than glass, but forming an impact resistant synthetic into a complex shape and structure required to diffuse the light into a desired plan is expensive. Outdoor street lights have shown a trend toward higher output sources which produce more heat and ultraviolet radiation which can discolor and even deform synthetic lenses, especially when placed close to the luminaire light-producing means where they are most effective to diffuse the light.

Escalating crime and violence continues to increase in the 1990's, which has created the need for a high performance protective shield for outdoor street lighting fixtures. This shield not only needs to protect the light producing means of the luminaire and light lens to allow it to perform the normal function of an outdoor street light, but it needs to have a several capabilities not previously required of a protective light shield. These features need to include the following:

(a) Ballistic resistance with no spalling or breakage to not only protect the light from the bullet, but have the ability to capture the bullet so that it will not bounce from the shield to cause damage or hurt elsewhere.

(b) The containment properties of the light shield must not obscure the quality of light transmission from the light lens to streets, sideways, walkways, etc.

(c) Simplified installation to decrease labor costs, but allow for easy maintenance of light fixture for bulb replacement.

U.S. Pat. No. 3,315,072 is an invention which relates to luminaries and, more particularly, to means for mounting the reflector and refractor to a luminaire having a sealed optical assembly. It also provides for new and improved means for mounting a luminaire optical assembly with independent latch spring members.

U.S. Pat. No. 4,010,362 is a shield which is permanently mounted to outdoor luminaries to prevent entry of birds into the interior. This protective shield only offers protection from birds to prevent the building of nests and living quarters.

U.S. Pat. No. 4,160,286 is a transparent hemispherical shield formed of polycarbonate resin plastic which was mounted to the existing fixture to cover a bulging bowl-shaped light diffusing glass lens of a luminaire to protect such lens. The hemispherical shape was structurally sound and placed a substantial distance outward the bulging light-diffusing lens to eliminate the chance of discoloration by heat. This invention is secured by return bent clips and lacks the torsion flex adjustment.

U.S. Pat. No. 4,432,045 is a transparent low profile shield in the form of a pan shield having a central bulge in the shape of a spherical segment. This shield was mounted with shield-mounting screws to the existing fixture. This invention does not have a simple one-bolt installation, torsion adjustment, or tear drop shape.

U.S. Pat. No. 4,460,945 is a laminate plate made from "Lexgard" (Trademark) mounted in a spaced relationship from the lens of the luminaire. This plate is a transparent shield mounted with (4) bolts countersunk through holes which are bored on the bottom of the housing. This invention does not have a torsion adjustment, or simple one bolt installation. "Lexgard" (Trademark) is a laminate between which there is a thick layer of acrylic. The purpose of the acrylic is to trap an object of penetration, yet acrylic shatters with a splinter effect which greatly affects the clear appearance of the shield and obscures the transmission of light.

All of the prior inventions have one or more of the following disadvantages:

(a) The lens cover is a round sphere which directly connects to the housing for the protection of the glass lens from distinctly small damaging items.

(b) The protective shield only offers protection from birds and other small inhabitants.

(c) The protective shields and/or covers directly attach to the light fixture with independent latches, clip, or bolts.

(d) Drilling or alteration of the existing light fixture is necessary for proper installation.

(e) No torsion adjustment to allow for energy absorption from the object which is trying to cause damage to the light lens.

(f) No form of attachment to the lens cover door to allow for the gusset locations which are inconsistent in the different models of cobra head street lighting fixtures manufactured.

(g) "Lexgard" (Trademark), as specified in U.S. Pat. No. 4,460,945, is an acrylic property which shatters with a splintering effect when a bullet attempts to penetrate a light shield made of "Lexgard" (Trademark). This penetration distorts the shield appearance and obscures the quality of light penetration.

(h) No bracket assembly providing a form of attachment on the pole arm.

(i) No dual layering using two types and thicknesses of polycarbonate sheets to achieve adequate ballistic protection, bullet containment with minimal distortion of shield clarity.

OBJECTS AND ADVANTAGES

Accordingly, several objects and advantages of my present invention are:

(a) Provides shield protection with dual polycarbonate sheets which are UV stabilized.

(b) Provides protection against vandalism, forced entry, and accidental damage.

(c) Provides containment properties for vandalism from small arms (22 to 44 caliber) with no spalling or breakage.

(d) Provides a torsion flex system with an adjustment bolt which allows the protective shield to absorb the energy from objects of forced entry such as bullets from small arms (22 to 44 caliber), rocks, small projectiles, etc, (e) Provides a torsion flex system which is galvanized to allow for a longer corrosion resistant life.

(f) Provides a simple one bolt installation with a clamp and bolt assembly which is galvanized and is mounted to the pole arm and not the light fixture.

(g) Provides a hook and cable assembly which is stainless steel to allow for a longer corrosion resistant life and provides a custom attachment to the existing lens door.

(h) Provides for easy fixture maintenance by dropping away for bulb access.

Further objects and advantages of my invention will become apparent from a consideration of the drawings and ensuing description.

DRAWING FIGURES

FIG. 1 Shows the torsion flex adjustment screw and one-bolt mounting bracket as attached to the pole arm. FIG. 1 is a view in detail of the portion indicated by the items 1 thru 7, 12 and 13 of FIG. 3.

FIG. 2 is a view in detail of the portion indicated by the items 8 thru 12 of FIG. 3.

DRAWING REFERENCE NUMERALS

1. Bracket Clamp (Steel With Galvanized Coating)
2. Clamp Bolt Assembly (Steel With Galvanized Coating)
3. Adjustment Carriage Bolt (Steel With Galvanized Coating)
4. Threaded Adjustment Housing (Steel With Galvanized Coating)
5. Arm-Shield Adjustment Arm (Steel With Galvanized Coating)
6. Luminaire
6A. Lens Door of the Luminaire
7. Assembly Bolts, Washer and Nut
8. Hook (Stainless Steel)
9. Cable (Stainless Steel)
10. Cable Assembly Bolt, Washer and Nut (Stainless Steel)
11. Rubber Grommet
12. Polycarbonate sheets, UV stabilized
13. Pole Arm

SUMMARY

This invention is a protective lens shield with a torsion mounting bracket. This shield is designed primarily to stop small arms fire and vandalism from damaging cobra head outdoor street lights. By incorporating the latest technology, I am able to provide lens and luminaire protection which has excellent ballistic resistance, easy fixture maintenance and installation, as well as a torsion adjustment to absorb the energy from objects such as vandalism by small arms (22 to 44 caliber).

DETAILED DESCRIPTION

Figure 1:
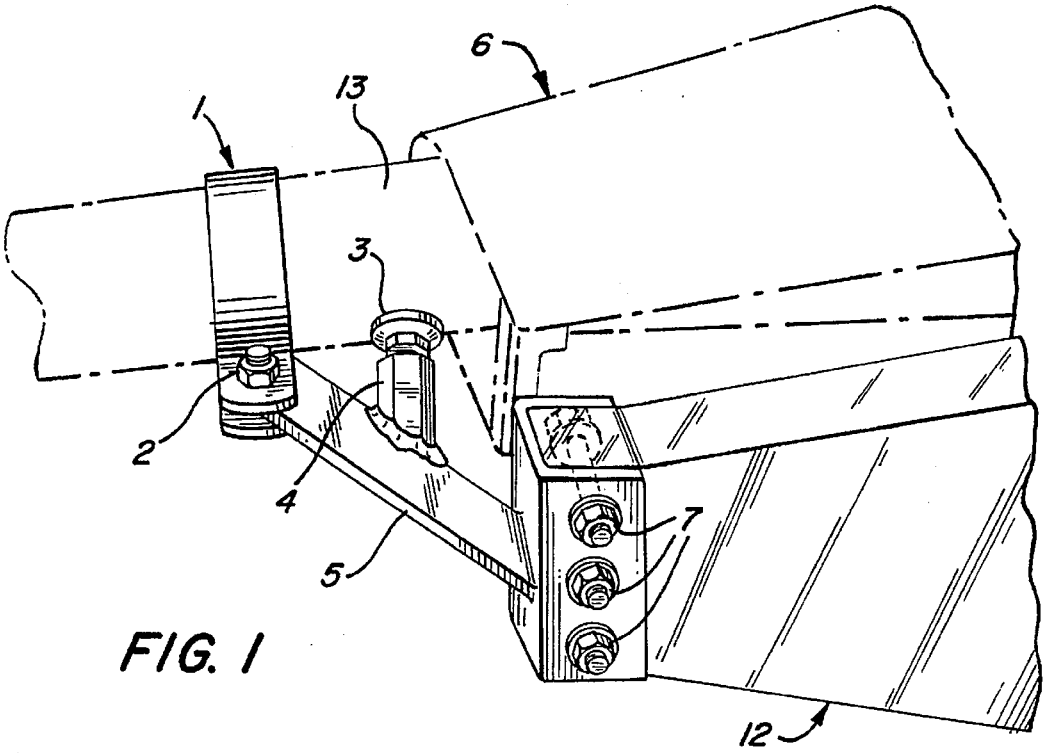
Figure 2:
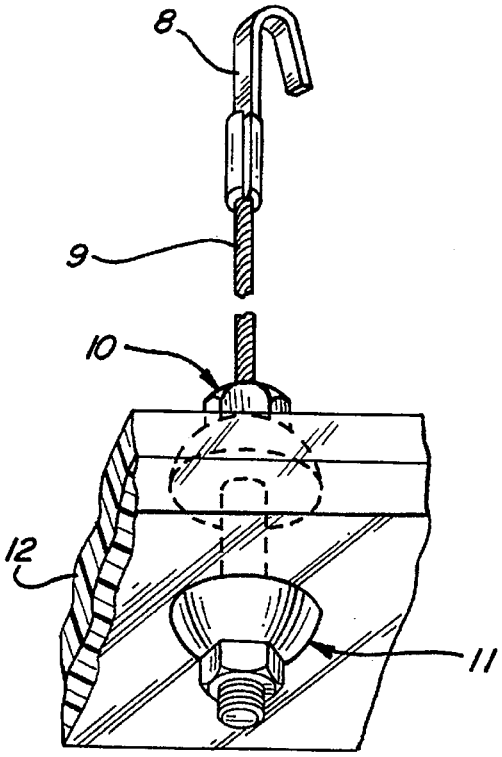
FIG. 2 Shows the hook and cable assembly.
Figure 3:
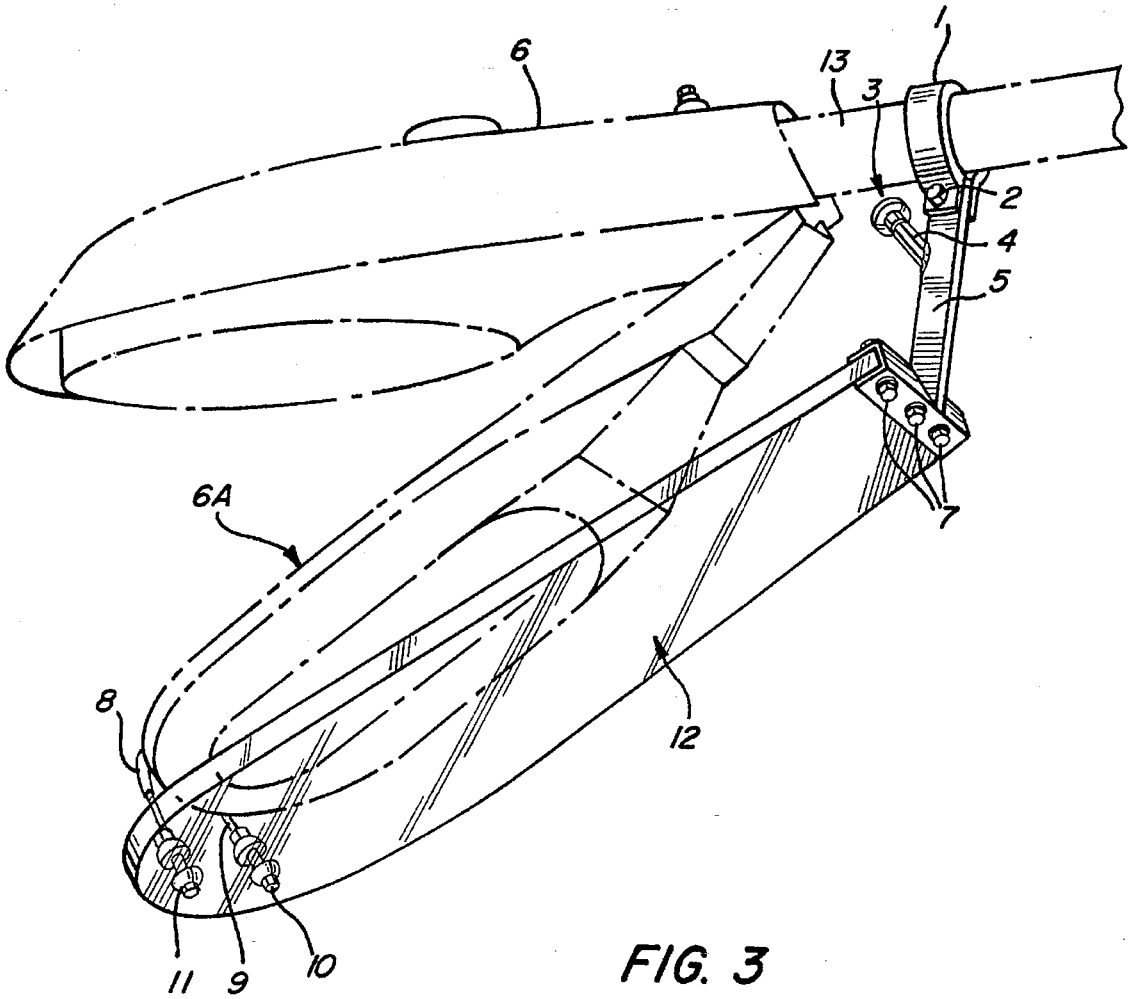
FIG. 3 Shows the torsion flex shield (flat) with the one-bolt mounting bracket, torsion adjustment screw, hook and cable assembly, as mounted on an existing cobra head outdoor street lighting fixture.

FIG. 3 shows a side profile of the torsion flex shield (flat). This shield is mounted to a pole arm (13) of a cobra head street lighting luminaire (6). FIG. 1 is a detail view of a galvanized coated steel clamp, bolt, and torsion adjustment system. FIG. 2 is a detail of a stainless steel hook and cable assembly. FIG. 1 and FIG. 2 are the primary connecting, mounting, and adjustment features of FIG. 3.

A shield is attached to a pole arm with a torsion bracket assembly (1–5, 7). A bracket assembly (1–5, 7) and (FIG. 1) is comprised of a galvanized coated steel bracket clamp (1) which opens and clips over an existing pole arm (13). A galvanized coated steel bolt assembly (2) secures a galvanized coated steel bracket clamp (1) to an existing pole arm (13) and attaches a galvanized coated steel arm-shield adjustment arm (5) to a galvanized coated steel bracket clamp (1). A galvanized coated steel bolt assembly (2) is tightened to ensure a secure connection between a pole arm (13) and a galvanized coated steel arm-shield adjustment arm (5).

A galvanized coated steel arm-shield adjustment arm (5) has a galvanized coated steel threaded adjustment housing (4) permanently attached at an approximate 42 degree angle so as to meet a pole arm (13) when a galvanized coated steel arm-shield adjustment arm (5) is properly attached to a galvanized coated steel bracket clamp (1). A galvanized coated steel threaded adjustment carriage bolt (3) is inserted into a galvanized coated steel threaded adjustment housing (4) and screwed in. A galvanized coated steel adjustment carriage bolt (3) is not screwed in tightly, since this bolt (3) is the torsion adjustment bolt which will be detailed in the "Operation" section of this patent application.

(FIG. 1) A galvanized coated steel arm-shield adjustment arm (5) has a flange at the base of the arm which contains three holes which match up to three holes that are drilled into the flat polycarbonate sheets (12) at the flat base of the tear drop shaped sheets. Three assembly bolts (7) are used to connect a galvanized coated steel arm-shield adjustment arm (5) to flat modified tear drop shaped polycarbonate sheets which are UV stabilized (12). The polycarbonate flat protective glazing sheets (12) can vary in thickness depending on the degree of protection required. The flat polycarbonate protective glazing sheets (12) are cut into a tear drop shape with a flat base. Approximate measurements for a small shield (50 to 100 watt light luminaire) would be a width of 15", length 28", with a tear drop base of 7". The tear drop shape can be modified by enlarging the width or length depending on the area of coverage needed. A galvanized coated steel torsion adjustment system (FIG. 1) and a hook and cable assembly (FIG. 2) would not be affected by modification of the tear drop shaped polycarbonate sheets.

Two holes are drilled into a curved top area of the flat tear drop shaped polycarbonate sheets to allow for attachment of a stainless steel cable assembly bolt (10) and insertion of two rubber grommets (11). Each of the two holes will contain an assembly comprised of the following which will become a stainless steel hook and cable assembly which is detailed in FIG. 2.

(FIG. 2) A stainless steel hook and cable assembly is a pair of hooks which connects the flat tear drop shaped polycarbonate sheets (12) to a lens door of a cobra head luminaire (6A). These stainless steel hooks (8) are important because they allow for a custom attachment to an existing lens door on one of various models of cobra head light luminaries. Gussets inside a lens doors (6A) are placed by manufacturers at inconsistent locations making a standardized hook attachment unfeasible. A hook and cable assembly (FIG. 2) is assembled in this manner. A stainless steel hook (8) is permanently connected to a stainless steel cable (9) which is permanently attached to a stainless steel cable assembly bolt (10). A stainless steel bolt assembly (8, 9, 10) becomes a single assembly. An assembly (8, 9, 10) then receives a stainless steel washer and rubber grommet (11) which is then inserted thru a hole which has been drilled in the curved top area of the tear drop shaped polycarbonate sheets (12). A stainless steel cable bolt assembly (8, 9, 10) then receives another rubber grommet (11), stainless steel washer and stainless steel nut to complete an assembly. A nut is then tightened to secure a stainless steel hook and cable assembly (FIG. 2) on the flat polycarbonate sheets (12).

Detailed Description—Operation

A torsion flex shield (flat) is a protective shield designed for Cobra head style outdoor street light fixtures. This shield operates by providing protection to the entire bottom portion of a luminaire, including the light lens. The protection provided by this shield offers people, places, and things quality street lighting that is not damaged by vandalism, small bullets, rocks, projectiles or objects of forced entry.

Once installed properly a torsion flex protection shield (flat) will minimize repair and maintenance costs by protecting the light lens and luminaire. The existing light lens will last longer and uninterrupted street lighting will be maintained.

This invention is very easily installed on existing an pole arm (13) of a cobra head street light luminaire (6). To install, remove the galvanized coated steel clamp bolt assembly (2) from the galvanized coated steel arm-shield adjustment arm (5). Install the galvanized coated steel clamp (1) on an existing pole arm (13) and attach to the galvanized coated steel arm-shield adjustment arm (5) with the galvanized coated steel clamp bolt assembly. Secure bolt and nut to tighten. Open existing lens door (6A) of luminaire (6) and attach both stainless steel hooks (8) over the edge of lens door (6A) making sure to avoid placing hooks where the interior gussets are located. Position lens door (6A) so that it is one inch from being closed. Adjust galvanized coated steel carriage bolt (3) to touch pole arm (13). This adjustment is what creates the torsion flex in the polycarbonate sheets so that energy will be absorbed when objects attempt to penetrate its surface. Penetrating objects, such as bullets, will penetrate the outer layer of polycarbonate and become trapped and/or embedded between the two layers. This feature protects the light lens as well as eliminates an object such as a bullet to bounce from the shield elsewhere. The rubber grommets located on each side of the polycarbonate sheets allow the flex of energy absorption to give yet hold the two sheets together. The grommets act very much like expansion joints. The torsion flex also allows for a shield to have the ability to be installed on a cobra head luminaire no matter what lighting angle the fixture has been positioned. The final step to install the protection shield is to close lens door (6A) by applying pressure with your hands. Make sure lens door (6A) is properly locked. Go back to the galvanized clamp bolt (2) and tighten.

Theory of Operation

The torsion flex shield is a protective shield for outdoor street lighting fixtures, primarily those of the cobra head style. The unique qualities of this shield is the torsion flex system. The torsion flex allows for a custom adjustment to a protective shield so that when an object attempts to penetrate, the energy from that object will be absorbed and the shield will flex with the impact. The style of design of this protective shield also allows for it to act like a lighting accessory instead of a fixed part of the light luminaire. It mounts to the pole arm, not the luminaire and it swings away with the lens door for easy bulb access.

Summary, Ramifications and Scope of Invention

Accordingly, you will see that this invention has been created with a desire to design a solution to a present day problem of small arms vandalism in the area of outdoor street lighting. Time, experience, and technology played an important role in designing the end product.

Factors which played a significant role in the research and design:

The types of street lights being damaged

The prior and present street light protection available

Luminaire protection as well as lens protection

The type of materials available with ballistic containment properties

The need for a light protection shield which would not mount directly to the luminaire Weight of the finished product Affordability of the finished product Non-corrosive materials Appearance With all of these elements taken into consideration, this invention is new, unique and provides a solution to a modern day problem. Although the description of the invention contains many specifics, these should not be construed as limiting the scope of the invention, but as merely providing illustrations of some of the presently preferred embodiments of this invention. For example, the flat protective tear drop shaped shield can have other modified shapes, such as longer and/or wider depending on the size and the area of required protection. The same holds true for the thickness of the polycarbonate sheets and the protection requirements.

Thus the scope of the invention should be determined by the appended claims and their legal equivalents, rather than by the examples given.

I claim:

1. A protective shield assembly comprising:

a flex shield having a first end and a second end;

a first attachment means for attaching the first end of the flex shield to a luminaire housing;

a second attachment means for attaching the second end of the flex shield to a light pole; and a torsion adjustment means for flexing the flex shield by providing a tensioning force disposed between the flex shield and the light pole.

2. The protective shield assembly of claim 1, wherein the torsion adjustment means provides a tensioning force disposed between the flex shield and the luminaire housing.

3. The protective assembly of claim 1, wherein the first attachment means comprises:

a first hook connected to a first cable, the first cable fastened to the first end of the flex shield.

4. The protective shield assembly of claim 3, wherein the first attachment means further comprises:

a second hook connected to a second cable, the second cable fastened to the first end of the flex shield adjacent to the first cable.

5. The protective shield assembly of claim 1, wherein the flex shield comprises at least two ultra-violet stabilized polycarbonate sheets.

6. The protective shield assembly of claim 1 further comprising:

a torsion adjustment arm having a shield end and a pole end, wherein the second attachment means fastens the second end of the flex shield to the shield end of the adjustment arm; and a third attachment means for attaching the pole end of the torsion adjustment arm to the light pole;

wherein the torsion adjustment means is disposed between the torsion adjustment arm and the luminaire housing.

7. The protective shield assembly of claim 6, wherein the third attachment means comprises a bracket clamp.

8. The protective shield assembly of claim 6, wherein the torsion adjustment means comprises:

a threaded adjustment housing; and a threaded adjustment carriage bolt;

wherein the adjustment carriage bolt is integrally threaded into the adjustment housing such that by adjusting the adjustment carriage bolt outwardly from the adjustment housing, the tensioning force is increased.

9. The protective shield assembly of claim 8, wherein the first and second hooks attach to a lens door of a cobra head light luminaire, without requiring any additional mounting holes in the lens door.

10. The protective shield of claim 9, wherein the flex shield is shaped to cover a cobra head light luminaire.

11. The protective shield of claim 10, wherein the torsion adjustment carriage bolt is adjusted to provide a predetermined amount of tension such that projectiles will embed in the polycarbonate sheets of the flex shield.

12. A protective lens shield assembly for protecting a street light, the street light having a luminaire housing and a supporting pole arm, the protective lens shield assembly comprising:

a torsion flex shield having a first end and a second end;

a hook and cable means for connecting the first end of the torsion flex shield to the luminaire housing;

a torsion adjustment arm having a shield end and a pole end;

a first fastening means for connecting the shield end of the torsion adjustment arm to the second end of the torsion flex shield;

a second fastening means for connecting the pole end of the torsion adjustment arm to the pole arm; and a torsion adjustment means for flexing the flex shield, wherein the torsion adjustment means is disposed between the torsion adjustment arm and the light pole, such that as a result of the tension created by the torsion adjustment means between the torsion adjustment arm and the light pole, the flex shield is flexed.

13. The protective lens shield assembly of claim 12, wherein the torsion flex shield comprises two ultra-violet stabilized polycarbonate sheets.

14. The protective lens shield assembly of claim 13, wherein the hook and cable assembly comprises two subassemblies, each sub-assembly comprising:

a hook;

a cable, having one end connected to the hook; and a connection means for connecting the cable to the flex shield;

wherein each hook of the two sub-assemblies hooks on the luminaire housing.

15. The protective lens shield assembly of claim 14, wherein the torsion adjustment means comprises:

a threaded adjustment housing mounted on the torsion adjustment arm; and a threaded adjustment carriage bolt;

wherein the adjustment carriage bolt is integrally threaded into the adjustment housing, such that by adjusting the adjustment carriage bolt outwardly from the adjustment housing, the torsion flex shield is flexed.

16. The protective lens shield assembly of claim 15, wherein the adjustment carriage bolt is adjusted to flex the torsion flex shield a predetermined amount.

17. The protective lens shield assembly of claim 16, wherein the second fastening means comprises a bracket clamp.

18. The protective lens shield assembly of claim 17, wherein the flex shield covers a cobra head light luminaire.

19. A protective lens shield assembly for protecting a street light, the street light having a luminaire housing and a supporting pole arm, the protective lens shield assembly comprising:

a torsion flex shield, comprising at least two polycarbonate sheets, having a first end and a second end;

a hook and cable means for connecting the first end of the torsion flex shield to the luminaire housing;

a torsion adjustment arm having a shield end and a pole end;

a first fastening means for fastening the shield end of the torsion adjustment arm to the second end of the torsion flex shield;

a second fastening means for connecting the pole end of the torsion adjustment arm to the pole arm; and a torsion adjustment means, disposed between the torsion adjustment arm and the light pole, for flexing the flex shield, comprising: a threaded adjustment housing on the torsion adjustment arm; and a threaded adjustment carriage bolt;

wherein the adjustment carriage bolt is integrally threaded into the adjustment housing, such that by adjusting the adjustment carriage bolt outwardly from the adjustment housing, the torsion flex shield is flexed.

20. The protective lens shield assembly of claim 19, wherein the torsion adjustment means is disposed between the flex shield and the luminaire housing.

* * * * *